United States Patent [19]

Wolfe

[11] 4,407,143

[45] Oct. 4, 1983

[54] FROSTED CONDIMENT HOLDER

[76] Inventor: John J. Wolfe, P.O. Box 497, Savannah, Tenn. 38372

[21] Appl. No.: 256,593

[22] Filed: Apr. 22, 1981

[51] Int. Cl.[3] ..... F28G 9/00

[52] U.S. Cl. ..... 62/303; 165/95; 62/246

[58] Field of Search ..... 62/303, 304, 255, 256, 62/85, 249, 246; 165/95

[56] References Cited

U.S. PATENT DOCUMENTS

| | | | |
|---|---|---|---|
| 2,248,467 | 7/1941 | Scilken | 62/303 X |
| 2,560,309 | 7/1951 | Stebbins | 62/303 X |
| 2,759,339 | 8/1956 | Kundert | 62/303 X |
| 2,962,874 | 12/1960 | Fitzgerald | 62/303 X |
| 3,320,964 | 5/1967 | Tripp | 62/303 X |
| 3,555,848 | 1/1971 | Johnson | 62/303 X |

*Primary Examiner*—Albert J. Makay
*Assistant Examiner*—Henry Bennett

[57] ABSTRACT

A condiment holder is provided with a top plate which includes a plurality of openings extending along the plate for supporting individual condiment containers within the holder, the plate having formed thereon a layer of frost thereby giving the appearance of the condiments resting in ice. The condiment holder comprises a conventional refrigeration unit which passes refrigerant through refrigerant lines placed underneath and in contact with the top plate adjacent each and every one of the plate openings thereby producing the frost or ice layer along the top surface of the plate and providing a refrigerated storage area below the top plate within the condiment holder to maintain the individual condiments refrigerated. The condiment holder is further provided with a water flush system which comprises a self-draining base placed along the bottom of the holder and a pair of water jets located on one end of the base which flush the base with water or other cleaning fluid which is then drained from the base.

9 Claims, 5 Drawing Figures

FROSTED CONDIMENT HOLDER

BACKGROUND OF THE INVENTION

1. Field of the Invention

This invention relates generally to a condiment holder and, more particularly, to condiment holders which are commonly known as frost top units which give the appearance that the individual condiments are resting in ice.

Specifically, the present invention relates to improvements over prior art frost top condiment holders used extensively for displaying condiments or other foods for self-service of such foods in many restaurants.

For the past few years, the addition of self-service salad bars in restaurants of all types have shown a tremendous increase. One of the attractive features of many salad bars is produced by what is commonly known as a frost top unit which is basically a refrigerated plate which frosts so as to give the appearance of the salad as well as the additional condiments, vegetables and dressing and the like resting in ice. However, while such frost top units have been successful in providing salad bar displays with a pleasing appearance, among the disadvantages or problems of these presently used food holding and displaying devices includes the manufacture of the frost top plate as a flat solid tray which cannot effectively hold the individual foods in one place thereby allowing the individual food items to be moved around to a position other than one which allows convenient self-service or a visually pleasing display. Similarly, condiments which are supported in small containers resting on such frost top trays are not refrigerated throughout as only the bottom of such containers are in contact with the refrigerated plate. Still another disadvantage feature resides in the difficulty involved in cleaning such prior art frost top units.

2. Disclosure Statement

U.S. Pat. No. 2,248,467, issued July 8, 1941 to Scilken, discloses a refrigerated display fixture for perishable foods comprising a top section formed from a plurality of plates each having a refrigerant passage therethrough, the top section also containing therein tray openings formed by the arrangement of the spaced plates for allowing the placement of food-holding trays. The tray openings can further include tubular connecting elements connecting the refrigerant passages of the various spaced plates and may further be arranged below the top to come in contact with trays disposed within the tray openings. U.S. Pat. No. 2,962,874, issued Dec. 6, 1960 to Fitzgerald, discloses a cooling tray for food products and beverages for self-service in which the cooling tray includes a stepped base member for supporting containers holding said food or beverage and further including raised sidewalls to form a cooling box and a top plate member arranged to receive the containers through a plurality of apertures therein and to support these containers at points spaced above the base member, the base member being arranged to be seated in the proximity of laterally spaced portions of a continuous cooling coil in which the cooling coil is supplied with a refrigerant from a compressor-pump combination. A similar device is disclosed in U.S. Pat. No. 3,555,848, issued Jan. 19, 1971 to Johnson, which discloses a self-contained portable cooler for food receptacles in which the cooler houses a complete small mechanical refrigeration unit, the evaporator of which is arranged to support a food receptacle which is placed on a cooled plate contacting the evaporator unit. U.S. Pat. No. 2,560,309, patented July 10, 1951 to Stebbins, also discloses a refrigerator system for produce stands which are of the open top variety and in which the refrigerating units and supports therefor form the partitions by which the rack is divided into a plurality of independent generally rectangular open top bins or food display compartments. U.S. Pat. No. 2,759,339, issued Aug. 21, 1956 to Kundert, discloses an improvement for refrigerating or frost top plates described above in which the frosted top is placed in heat conducting contact with refrigerant conduits while the frame for the frost top plate is placed in heat conducting contact with warmed fluid to prevent frost from forming on the frame. U.S. Pat. No. 3,320,964, issued May 23, 1967 to Tripp, discloses a chemical flush system for use in cleaning and maintaining refrigeration equipment such as refrigerated cases used commercially in retail food stores. None of the above patents, however, recognizes the advantages of providing a condiment holder or refrigerated food display device, in general, with both a frosted top to provide cooling and a pleasing appearance as well as storage area below the frosted top which is also refrigerated to maintain the displayed foods fresh. Likewise, there is no teaching or suggestion in the prior art of combining such frost top condiment holders with a self-draining cleaning fluid flush system. While the Tripp patent adds a chemical flush system to a refrigerated display case, the display case of Tripp is unlike the frost top condiment holder of the present invention.

SUMMARY OF THE INVENTION

Briefly, the present invention is an improvement over prior art frosted top plates used for displaying salads and associated condiments and the like. In accordance with the present invention, a refrigerated condiment holder is provided, the condiment holder including a top plate which is covered with a layer of frost due to the placement of refrigerant conduits in heat exchange contact with the bottom surface of the plate, the top plate being provided with a plurality of container openings through which containers carrying foods may be placed. The condiment holder of the present invention includes a cooled storage area below the frosted top plate which maintains the foods in a fresh condition. The storage area is provided with a self-draining cleaning system which flushes the storage area of any food contaminants. The cleaning system comprises a pair of nozzles which direct cleaning fluid along the bottom and sides of the storage area within the condiment holder, the bottom of the storage area including a drain through which the cleaning fluid and separated contaminants are discharged. Accordingly, a condiment holder is provided which will maintain the individual foods in the position at which they are placed, is capable of holding different types of condiments or foods depending upon the sizes of openings within the frost top plate, will produce a frost or ice appearance to exist around the tray openings and on the cover of the individual condiment containers presenting a unique appearance of mounded ice around the individual containers placed in the tray openings and which cools those containers placed within the tray openings not only from the top of the container but from the cooled storage area existing below the frost top plate unit by the placement of the refrigerant conduits underneath the frost top and adjacent each of the tray openings.

A primary object of the present invention, therefore, is to provide an improved refrigerated condiment holder which contains none of the disadvantageous features of prior art devices of similar type.

In accordance with the foregoing object, another object of the invention is to provide a refrigerated condiment holder which includes a frosted top to provide the appearance of the condiments resting in ice and in which the top comprises a plurality of tray openings for the holding of individual food or condiment containers, the holder further including a refrigerated storage area positioned below the frosted top and which provides cooling of the bulk of the individual containers passing through the frosted top.

Still another object of the present invention is to provide a conduit holder of the above type which further contains a self-draining fluid cleaning system for maintaining the storage area free from contaminants.

Still yet another object of the present invention is to provide a refrigerated condiment holder provided with a decorative frost top unit which is capable of holding and maintaining in position a plurality of foods and condiments and maintain the foods and condiments cool and fresh and is further provided with a self-draining cleaning system which allows the simple and efficient cleaning of the device thus maintaining the necessary sanitary conditions.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
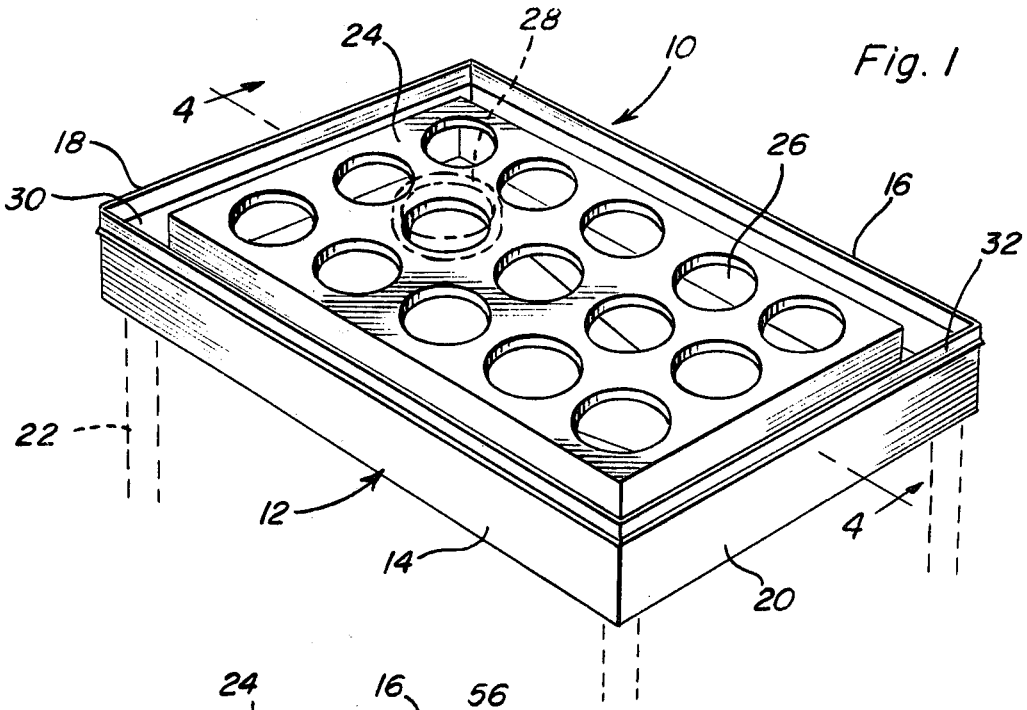
FIG. 1 is a perspective view illustrating the refrigerated condiment holder of the present invention.
Figure 2:
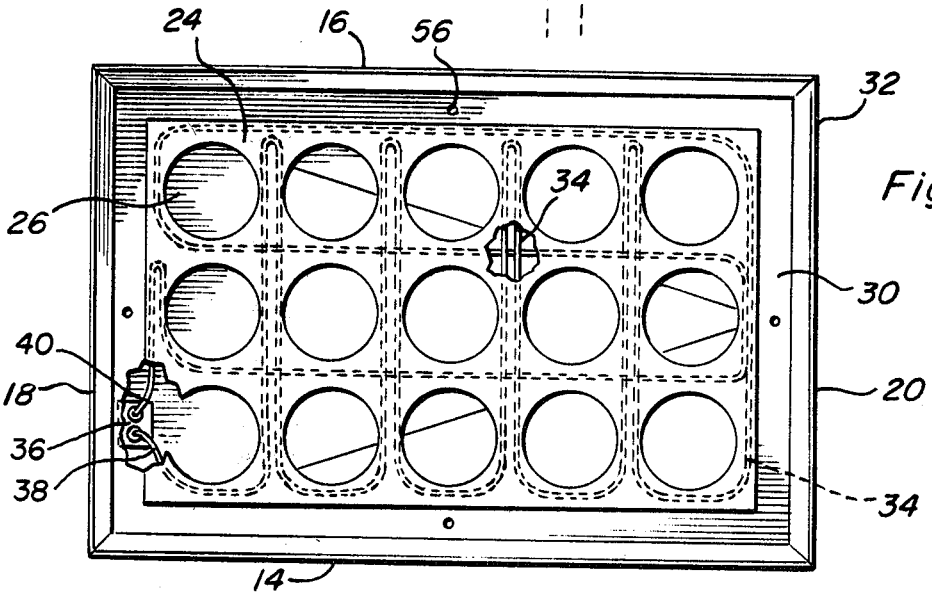
FIG. 2 is a top plan view of the frosted condiment holder partly broken away to illustrate the placement of the refrigerant conduits utilized to form the frosted top plate and to maintain the refrigerated storage area there below.
Figure 3:
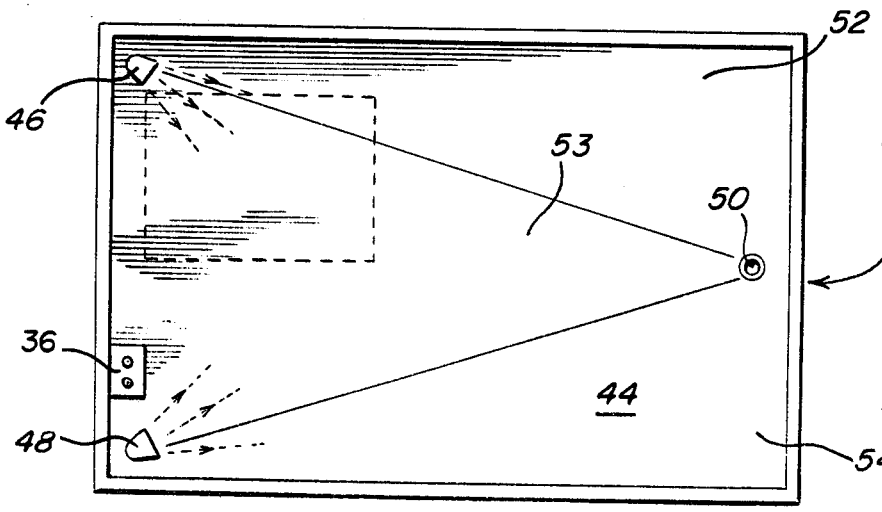
FIG. 3 is a top elevational view of the condiment holder of the present invention with the frosted top unit and associated refrigerant conduits removed and thus illustrates the self-draining fluid cleaning system.
Figure 4:
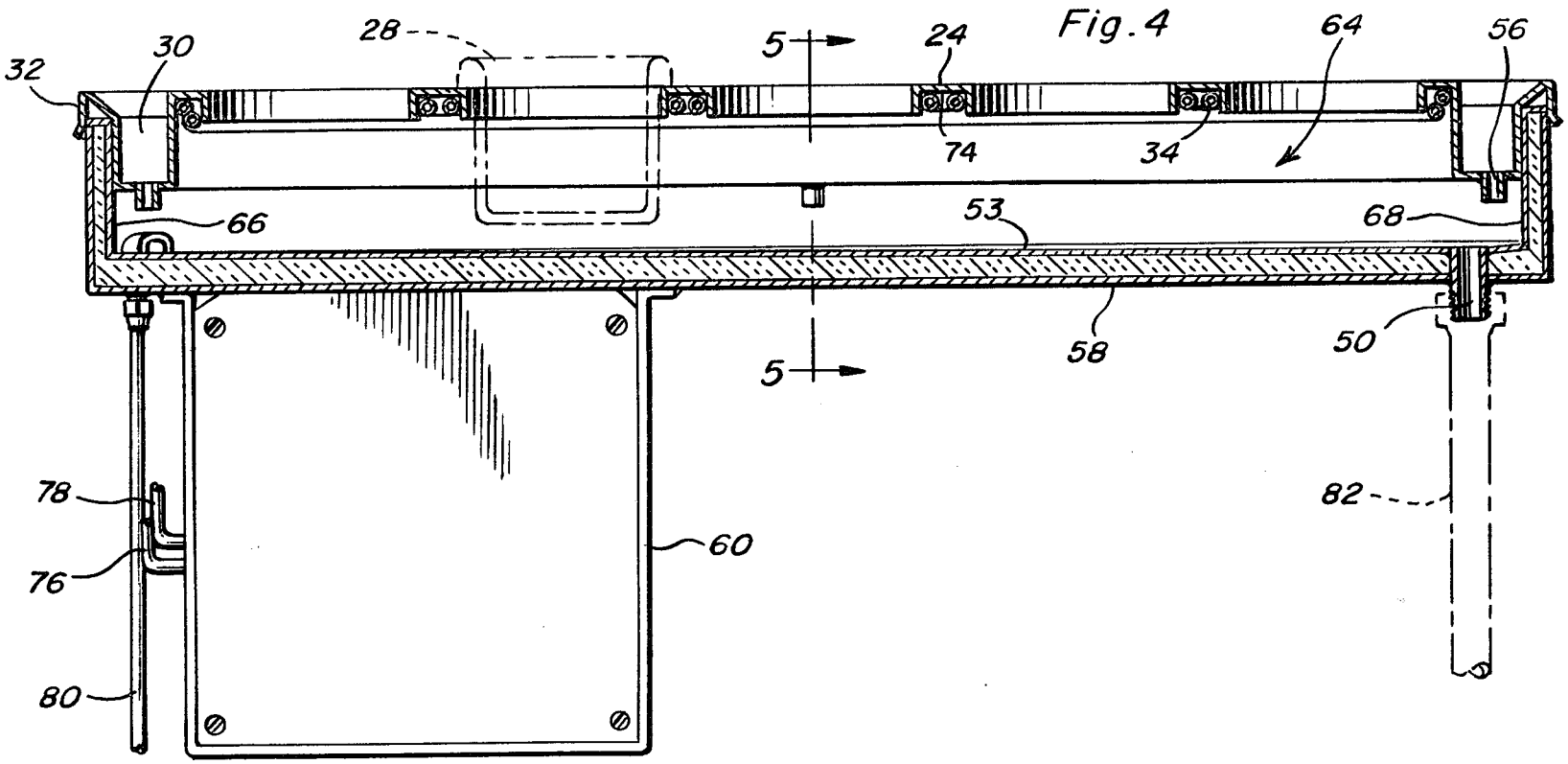
FIG. 4 is a longitudinal sectional view of the frosted condiment holder taken generally along the line 4—4 of FIG. 1.
Figure 5:
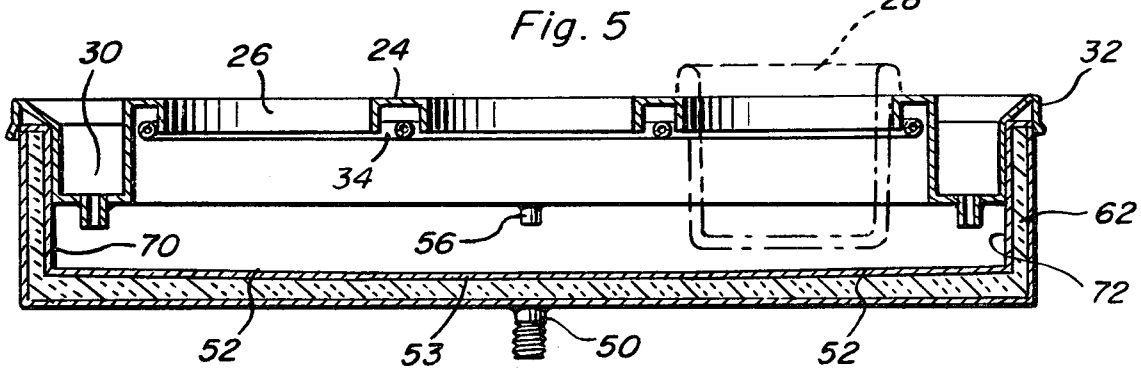
FIG. 5 is a transverse sectional view of the frosted condiment holder taken generally along the line 5—5 of FIG. 4.

Referring to FIGS. 1 through 3, it can be seen that the refrigerated condiment holder of the present invention generally indicated by reference numeral 10 comprises a generally rectangular shaped base 12 formed by sidewalls 14 and 16 and end walls 18 and 20. Base 12, if desired, can be supported by four support legs 22. Obviously, base 12 may take many forms and shapes in order to accommodate the numerous variety of sites and situations in which condiment holder 10 may be utilized. Positioned over base 12 is frost top unit 24 which is a plate containing a plurality of container openings 26 which may be of varying size, although for the purposes of illustration only, all of openings 26 are shown of the same diameter. Openings 26 support a plurality of condiment containers 28 which usually include an outer rim or lip which extends over the surface of frost top unit 24. As best seen in FIGS. 1, 4 and 5, frost top unit 24 includes a perimeter gutter 30 which collects condensate formed from the melting of the frost layer which is formed over the surface of frost top unit 24. Frost top unit 24 further includes an outer perimeter lip 32 which secures frost top unit 24 onto base 12.

Positioned underneath frost top unit 24 and attached to the bottom surface thereof is refrigerant conduit 34 which can be seen in FIG. 2 as following a path which travels adjacent each of container openings 26 such that each opening 26 is virtually surrounded by refrigerant conduit 34. As can be seen, refrigerant conduit 34 travels between each row of openings 26 as well as between each column thereof and between the outermost openings 26 and the outer perimeter of frost top unit 24 adjacent gutter 30. In this manner, a layer of frost or ice forms on the top of frost top unit 24 and maintains the individual condiment containers 28 and their contents refrigerated. Refrigerant conduit 34 is essentially the evaporator of a conventional refrigeration system which includes a refrigerant vapor compressor and compressed vapor refrigerant condenser (not shown). Refrigerant conduit 34 is linked to the conventional refrigeration system by means of holder 36 which holds conduit inlet 38 and refrigerant return 40 which returns the evaporated refrigerant that travelled the total path along the bottom surface of frost top unit 24 by means of refrigerant conduit 34.

Positioned underneath and spaced from frost top unit 24 is water or cleaning fluid flush system 42 which comprises pan 44 which is shaped so as to direct all water or cleaning fluid dispensed from nozzles 46 and 48 to drain 50. Nozzles 46 and 48 direct water or chemical cleaning fluid onto the top surface of pan 44 thus cleaning or flushing any contaminants thereon into drain 50. As can be seen, nozzles 46 and 48 are spaced so as to disperse cleaning fluid substantially over the entire surface of pan 44. The self-draining feature of pan 44 is provided by the inwardly slanting sidewalls 52 and 54 which direct the fluid onto downwardly slanted surface 53 which provides for movement of the cleaning fluid by gravity into drain 50. Pan 44 also collects condensate passing into gutter 30 by means of drains 56, four in number, which are placed in gutter 30 adjacent each end and sidewall of condiment holder 10. Condensate discharge through drains 56 contact pan 44 and flows by gravity to drain 50 where all condensate is removed from condiment holder 10.

A detailed arrangement of the components which form condiment holder 10 can be seen in FIGS. 4 and 5. As can be seen, base 12 further includes a bottom wall 58 which has welded or otherwise attached thereto cabinet 60 which holds the typical refrigeration equipment including compressor and condenser units. Placed adjacent each end and sidewall of base 12 is a layer of thermal insulation 62 which maintains what can be characterized as storage area 64 cold so as to provide refrigeration of the contents placed in container 28, the major portion of which extends into storage area 64. Storage area 64 is formed by the space existing between frost top unit 24 and pan 44 and is further bounded by end walls 66 and 68 and sidewalls 70 and 72 of water flush system 42.

Refrigerant conduit 34 is preferably welded to bottom surface 74 of frost top unit 24. Refrigerant conduit 34 is positioned to pass the refrigerant along each side of container openings 26 as illustrated in FIGS. 2 and 4. Refrigerant conduit 34 receives the expanding refrigerant via connector 76 connecting a conventional expansion valve (not shown) to holder 36 while conduit 78 returns evaporated and warmed refrigerant from holder 36 to the compressor unit held within refrigeration cabinet 60.

The spray nozzles 46 and 48 can be supplied from a supply conduit 80 which is linked to a source (not shown) of water or cleaning fluid. A common T-connector can be used to supply both spray nozzles 46 and 48 from supply conduit 80. Likewise, a separate supply conduit may be utilized to supply each of the respective spray nozzles. The downward slanting floor of center section 53 of pan 44 allows all wash water or fluid to enter drain 50 which is fastened to drain pipe 82 for removal of spent fluid from condiment holder 10.

In operation, a conventional refrigeration system supplies refrigerant to refrigerant conduit 34 which is placed in heat conducting contact with frost-top unit 24 so as to form a layer of frost or ice thereon due to condensate from the atmosphere. Refrigerant is passed throughout the total area of frost top unit 24 so as to cool the tops of each of containers 28 placed in openings 26. Further, storage area 64 being insulated from the atmosphere by means of insulation layer 62 is also cooled by means of the expanding refrigerant through refrigerant conduit 34 and thus refrigerates the contents contained within containers 28. By forming storage area 64 within condiment holder 10, relatively larger containers 28 can be utilized and thus hold a relatively larger quantity of salad dressings and other condiments and yet remain refrigerated and thus fresh. Further, the tops of containers 28 remain substantially flush with frost top unit 24 enhancing the appearance of the food display by giving the appearance of the containers resting in ice due to the formation of the frost layer on the surface of frost top unit 24. Once refrigerant has passed throughout the full circuit laid down by refrigerant conduit 34, warmed refrigerant is returned to the refrigeration unit via conduit 78. Periodic cleaning of condiment holder 10 is accomplished by simply opening nozzles 46 and 48 which dispense the stream of cleaning fluid along the sides and bottom surface of pan 44 thus removing any contaminants which may be adhered. The cleaning fluid and contaminants are removed by gravity flow through drain 50 and out of condiment holder 10 via conduit 82. In this manner, condiment holder 10 does not have to to be disassembled for each cleaning and this is much simpler and more economical to operate than prior art frost top units.

Materials for the construction of condiment holder 10 can vary, although metal seems to be the most preferred material, especially for frost top unit 24. Metal has the proper heat conducting properties which would allow the formation of the layer of frost or ice on the top surface of frost top unit 24. The materials chosen should be rust and corrosion resistant and should greatly resist the growth of mold, fungus and bacteria so as to maintain condiment holder 10 as sanitary as possible.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A condiment holder comprising a top plate containing at least one opening therein, a condiment container inserted into said opening, a refrigerant path placed adjacent said top plate and in heat exchange communication therewith so as to cool said top plate and form a layer of frost thereon, means positioned below said top plate and forming an enclosure for the space below the plate whereby the refrigerant path cools the enclosed space and the portion of the container therein, means for collecting condensate from said frost layer formed on said top plate, said collecting means including a fluid discharge means for directing fluid on said collecting means to clean said collecting means from contaminants formed thereon, said collecting means including a drain means to remove said condensate and discharged fluid from said condiment holder.

2. The condiment holder of claim 1 wherein said collecting means is shaped so as to cause said discharged fluid and said condensate to flow by gravity into said drain.

3. A refrigerated condiment holder comprising a frost top unit including a plate having a plurality of openings therethrough for receiving and holding condiment containers with the containers depending substantially into the area below said plate, refrigerant conduit means below said plate and in heat exchange relation thereto to form frost on the upper surface of said plate thereby forming a frost top unit, said refrigerant conduit means being disposed outwardly of the periphery of said openings and adjacent the undersurface of the plate to enable containers of different vertical dimensions to be fully inserted into the openings without contact with the refrigerant conduit means, said refrigerant conduit means being disposed adjacent the periphery of said openings to cool the area below the plate and maintain the containers and products therein at a substantially constant cool temperature throughout the length of the containers.

4. The refrigerated condiment holder of claim 3 wherein the area below the plate is enclosed by a depending peripheral wall and a bottom wall, said refrigerant conduit means cooling said area and the entire surface area of the containers extending below said plate.

5. The refrigerated condiment holder of claim 4 wherein said peripheral wall and bottom wall include a layer of thermal insulation to maintain a substantially constant temperature in the enclosed area below the plate.

6. The refrigerated condiment holder of claim 4 wherein said bottom wall includes a drain opening, said bottom wall being inclined toward said drain opening for gravity flow to the drain opening, a plurality of spray nozzle means located remotely from the drain opening and adjacent peripheral areas of the bottom wall and discharging liquid cleaning solution at points adjacent the bottom wall and in the direction of the drain opening for flush cleaning of the interior surfaces of the walls.

7. The refrigerated condiment holder of claim 6 together with a peripheral trough around said plate for collecting liquid therefrom including melted frost and condiment spillage, and drain means in the bottom of said trough for draining collected liquid onto the bottom wall to maintain said plate in sanitary condition and facilitating the cleaning of said plate.

8. The refrigerated condiment holder of claim 4 wherein said plate and containers are constructed of heat conducting material with the containers having a top lip engaging the periphery of the openings with the refrigerant conduit means also forming frost on the lip at the upper end of the containers above the plate to provide the appearance of mounds of ice around the containers.

9. The refrigerated condiment holder of claim 8 wherein said peripheral wall and bottom wall include a layer of thermal insulation to maintain a substantially constant temperature in the enclosed area below the plate, said bottom wall including drain opening, said bottom wall being inclined toward said drain opening for gravity flow to the drain opening, a plurality of spray nozzle means located remotely from the drain opening and adjacent peripheral areas of the bottom wall and discharging liquid cleaning solution at points adjacent the bottom wall and in the direction of the drain opening for flush cleaning of the interior surface of the walls, a peripheral trough around said plate for collecting liquid therefrom including melted frost and condiment spillage, and drain means in the bottom of said trough for draining collected liquid onto the bottom wall to maintain said plate in sanitary condition and facilitating the cleaning of said plate.

* * * * *